United States Patent [19]

Primke et al.

[11] 4,263,468

[45] Apr. 21, 1981

[54] PLASMA-ARC MELTING FURNACE

[75] Inventors: Konrad Primke, Mölkau; Peter Papsdorf, Leipzig, both of DDX

[73] Assignee: VEB Mansfeld Kombinat Wilhelm Pieck, Lutherstadt-Eisleben, German Democratic Rep.

[21] Appl. No.: 920,279

[22] Filed: Jun. 29, 1978

[30] Foreign Application Priority Data

Jun. 29, 1977 [DD] German Democratic Rep. ... 199770

[51] Int. Cl.[2] ..... H05H 1/00; H05B 7/00

[52] U.S. Cl. ..... 13/2 P; 13/33

[58] Field of Search ..... 13/2, 2 P, 9, 26 S, 13/26, 33

[56] References Cited

U.S. PATENT DOCUMENTS

| | | | |
|---|---|---|---|
| 3,558,791 | 1/1971 | Grachev et al. | 13/9 |
| 3,999,979 | 12/1976 | Outhwaite et al. | 13/33 X |
| 4,033,562 | 7/1977 | Collin | 13/26 |

*Primary Examiner*—Roy N. Envall, Jr.

[57] ABSTRACT

Plasma-arc furnace for continuously melting metals, particularly for melting down recovered light-metal scrap, comprising a trough-shaped melting vessel with a substantially vertical stack thereabove, a feeding device above the stack for feeding in materials to be melted, a sump below the vessel and a charge chute between the vessel and the sump, with at least two plasma-arc burners so arranged that base points of their arcs are within an area of transition from the chute to the sump, a stirring device, removing means for molten metal, and means for scrubbing and cleaning exhausted plasma gas so that the latter can be discharged into the atmosphere.

11 Claims, 3 Drawing Figures

PLASMA-ARC MELTING FURNACE

Figure 1:
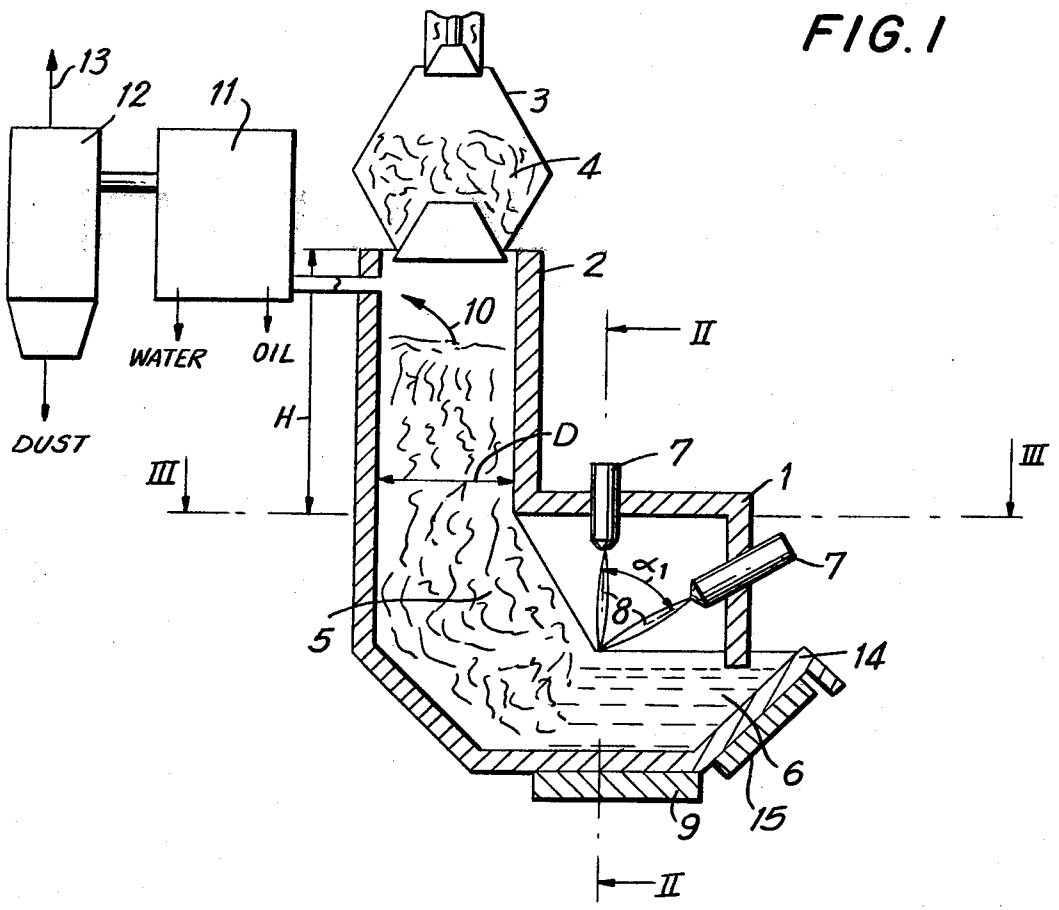

The invention relates to a plasma-arc furnace for continuously melting metals, particularly for melting down recovered light-metal scrap.

Plasma-arc melting arrangements are already known for continuously melting metals.

Thus, according to the Industrial Patent of the German Democratic Republic (henceforth to be abbreviated) No. 90,402 a plasma-arc melting arrangement has been proposed in which the heating-up or melting procedure and the subsequent process phase are carried out in two or more process vessels which are however interconnected. The primary process vessel and the subsequent secondary process vessel or vessels are united by one or more connecting channels. They are so designed that the process vessels can be tilted about the vertical axis. The process vessels as well as the connecting channels can be fitted with one or more counter-electrodes. The primary process vessel is provided with a known feeding device which can be disposed either in the cover or at the side of the process vessel.

Furthermore a multi-chamber plasma-induction melting furnace is known with a hermetically closing, multi-divided cover wherein the geometry of the plasma melting chamber is adapted to the energy output of the plasma arc, the plasmatron being disposed at an angle to the melting-stock surface or in a recess of the plasma melting-chamber wall. The plasma and the induction melting chambers are connected by a channel and can be tilted together or separately (Ind. Pat. of German Dem. Rep. No. 109,787).

Another plasma-arc melting furnace which has the plasmatrons disposed below the solid melting-stock surface is characterized in that the furnace vessel has at least two furnace chambers that constitute a unit but have different geometries. The plasmatrons are disposed in an appropriate angular range to the furnace axis, namely within alcoves of the furnace. Furthermore the furnace-chamber parts are separately or simultaneously tiltable and/or dischargeable, and the cover of the vessel is fitted with a charging device (Ind. Pat. of German Dem. Rep. No. 109,789). In a principal embodiment of this furnace vessel, one or more working chambers are connected with the melting furnace by way of openings for collecting the melt.

All described furnace types display appropriate additional heating systems.

These known plasma-arc melting arrangements for continuously melting metals have various drawbacks. Thus, flexibility of the technology of the melting operation is limited because of the fact that they consist of several interconnected process vessels, although it becomes necessary for the melting operation to pour off the molten metal either immediately upon melting or to lead the same to a melt processing equipment and/or to a mixer for adjusting the required alloy.

The statement adopted in Ind. Pat. of German Dem. Rep. No. 109,787, according to which the produced energy drops to about 10% at a distance of approx. 150 mm from the plasmatron, and essentially depends only upon the type of the plasmatron, cannot be confirmed by investigations carried out in this field (W. Rother; V. Bergmann; R. Kulessa; G. Petzold—Energy Balance of a Plasma Arc-XIX. International Scientific Colloqium. TH Ilmenau 1974, No. 2, pp. 65 to 70).

A basically erroneous assumption of the energy output of plasma arcs constituted the starting point. Accordingly, there is no real basis for the furnace geometry, adapted to the energy output of the plasma arc, in regard of which final conclusions were drawn.

A further disadvantage of already known plasma-arc melting arrangements consists in that it is not possible to obtain a stable burning of the plasma arc in the scrap charge or fill, considering necessarily high charges that lie at the magnitude of the plasma-arc length. The plasma arc burns in an unsteady manner and is being frequently blown out by the effect of the own magnetic field.

A further drawback of the known plasma-arc melting arrangements for continuously melting metals consists in that they do not include any equipment that would prevent the entry of foreign matter into the melt, contained in the scrap, such as humidity, oil, dirt, etc. The quality of the molten metal is considerably reduced by such foreign substances.

It is one of the objects of the invention to provide a plasma-arc melting furnace with which the metal yield can be increased while simmultaneously improving the quality of the molten metal.

It is the task of the invention to provide a plasma-arc melting arrangement for melting metals, particularly for melting down recovered light-metal scrap, consisting of a process vessel, taking into account the structural characteristics of the material being melted and the melting-down behavior of the plasma arc, and which at the same time minimizes the share of foreign substances that reach the melt, right in the raw material.

According to the invention the object is solved in that the plasma-arc melting furnace consists of a furnace vessel having a trough-shaped layout, into which leads a stack or shaft that is substantially vertical or only slightly tilted with respect thereto, the ratio of the shaft height to the shaft diameter being greater than or equal to unity.

The furnace is charged by means of a gas-tight feeding device that is disposed at the upper end of the stack. The plasma burner or burners are so arranged that the base point(s) of the plasma arc(s) is (are) at a location where the conical scrap chute has its transition to the furnace sump.

The arrangement is vertical or with an angle of the longitudinal axis tilted between 0° and 60° away from the vertical.

When using several plasma burners they are disposed vertically or at an angle of 0° to 60°, in the transversal axis of the plasma-arc furnace, for purposes of agitating the melting bath, which leads to a further increase of the melting speed and to an elimination of significant temperature differences.

In order to attain a uniform metal temperature in the furnace sump and to increase the melting speed, an electromagnetic stirring device is provided at the bottom of the furnace or on the furnace wall in the region of the furnace sump. Energy transfer to the raw material is accomplished by radiation from the plasma-arc column onto the scrap fill chute, by conduction and convection in the region of the base point of the plasma arc onto the furnace sump, and by convection of the plasma gas through the scrap fill within the fill cone and the shaft or stack.

Below the gas-tight feeding device, an exhaust opening is provided at the upper end of the shaft, which is followed by a known gas cooler and a known cyclone, for purposes of removal of vapor-deposited volatile components such as oil and water as well as of entrained dust.

For collecting the molten metal an overflow is provided in the trough-shaped furnace vessel, sealed off against the inner space of the furnace, and/or an electromagnetic conveying chute is being used.

Figure 2:
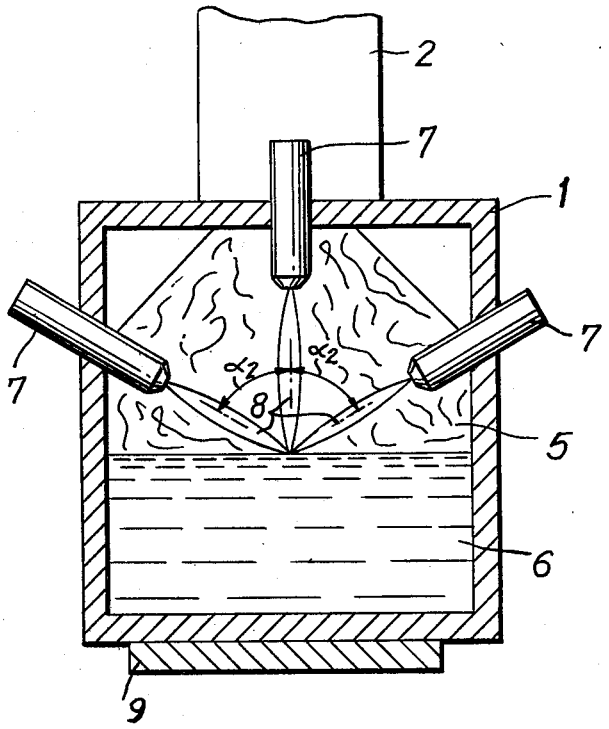
Figure 3:
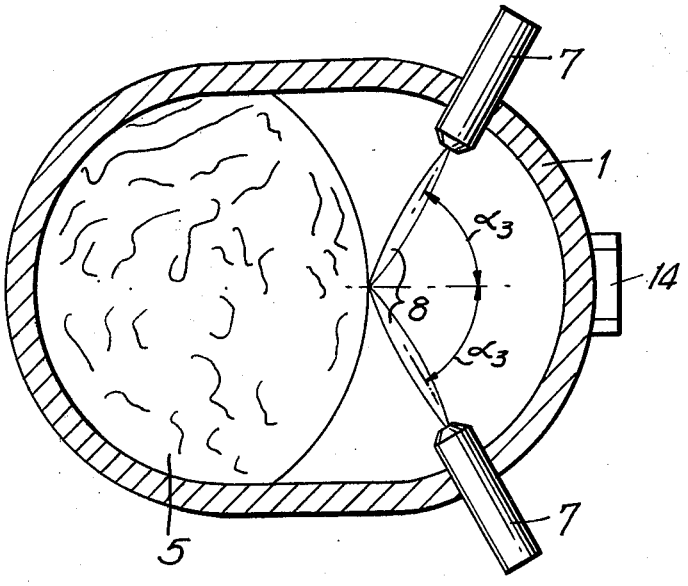

Further objects, features and advantages of the invention will become better understood from the description that follows, when referring to the accompanying drawings, wherein FIG. 1 constitutes a vertical, longitudinal section through an exemplary embodiment of the plasma-arc melting furnace according to the invention;

FIG. 2 is a substantially vertical section taken along line II—II across the furnace of FIG. 1; and FIG. 3 is a substantially horizontal section taken along line III—III of FIG. 1.

As can be seen from FIG. 1, the plasma-arc furnace consists of a trough-shaped furnace vessel 1 having on top of it a substantially vertical shaft or stack 2 which may be slightly tilted with respect to the vertical. The ratio of the shaft height H to the shaft diameter D is larger than or equal to unity. The plasma-arc melting furnace is being continuously or quasi-continuously fed with a material 4 to be melted by way of a gas-tight feeding device 3 disposed at the upper end of the shaft 2. A conical scrap fill chute 5 formed within the furnace space has a transition toward a furnace sump 6.

One (or more) plasma-arc burner(s) 7 is (are) so arranged that the base point(s) of the plasma-arc(s) 8 is (are) situated within the area of the transition from the fill chute 5 to the furnace sump 6. As a result, the scrap fill height in the range adjacent the plasma arc(s) is low so that quiet and stable burning of the arc(s) 8 is achieved. The plasma-arc burner(s) 7 is (are) vertically disposed in the longitudinal furnace axis, or at an angle $\alpha$ 1 between 0° and 60° to the vertical.

As shown in FIG. 2, when several plasma-arc burners 7 are being applied, these can furthermore be set up at an angle $\alpha$ 2 betweeen 0° and 60° to the vertical in the transversal axis, and according to FIG. 3, at an angle $\alpha$ 3 between 0° and 90° to the longitudinal axis of the plasma-arc melting furnace. Owing to the inclined arrangement of the plasma burners 7, the kinetic energy of the plasma arcs 8 causes a movement of the melting bath, leading towards an increase of the melting speed and towards a reduction of larger temperature differences within the furnace sump 6.

In order to attain a uniform metal temperature in the furnace sump 6 and to increase the melting speed, an electromagnetic stirring device 9 is provided at the furnace bottom or laterally, on the furnace wall, in the range of the furnace sump 6.

Hot plasma gas 10 streams through the scrap fill and is being removed at the upper end of the shaft 2, below the gas-tight feeding device 3, to be led to a known gas cooler 11 so that entrained foreign substances such as oil and water can be separated. Dust, entrained as a result of the high streaming velocity, is removed in a cyclone 12. Cleaned waste gas 13 can thus be discharged into the atmosphere without contaminating the environment.

An overflow 14 may be provided, sealed against the inner space of the furnace, for continuously removing the molten metal. Alternatively, discontinuous removal can be accomplished by means of an electromagnetic conveying chute 15 for further processing.

It will be understood in the usual manner that additions to, changes in and departures from the disclosed exemplary furnace embodiment are possible, readily understood by experts, that do not depart from the spirit and scope of the invention.

What we claim is:

1. A plasma-arc furnace for continuously melting metals, particularly for melting down recovered light-metal scrap, comprising, in combination: a trough-shaped melting vessel (1); a substantially vertical stack (2) above said vessel, said vessel and said stack together defining an inner furnace space; said stack serving to receive material (4) to be melted, by way of a feeding device (3), provided on top of said stack and sealed thereagainst in a gas-tight manner; a sump (6) below said vessel; a conical charge chute (5) formed within said furnace space between said stack and said sump; at least two plasma-arc burners (7) so arranged that base points of their arcs (8) are within an area of transition from said chute to said sump; an electromagnetic stirring device (9) associated with said sump; means (14, 15) for removing molten metal, disposed at said sump; and means (11, 12) for cleaning exhausted plasma gas (10) that is led thereto at a location in said stack just below said feeding device, by removing from the gas at least one of gaseous, liquid and pulverulent foreign substances so that cleaned exhaust gas (13) can be discharged to the atmosphere.

2. The furnace as defined in claim 1, wherein said gas cleaning means includes at least one of a gas cooler (11) and a dust cyclone (12).

3. The furnace as defined in claim 1, wherein said stirring device (9) is secured to the bottom of the furnace.

4. The furnace as defined in claim 1, wherein said stirring device (9) is secured to a furnace wall in the region of said sump (6).

5. The furnace as defined in claim 1, wherein said removing means includes an overflow (14) for continuously discharging the molten metal.

6. The furnace as defined in claim 1, wherein said removing means includes an electromagnetic chute (15) for at least discontinuously discharging the molten metal.

7. The furnace as defined in claim 1, wherein said stack (2) is slightly tilted with respect to the longitudinal axis of the furnace, which is substantially vertical.

8. The furnace as defined in claim 1, wherein the ratio of the height (H) of said stack (2) to its diameter (D) is greater than or equal to unity.

9. The furnace as defined in claim 1, wherein said at least two burners (7) are disposed substantially along the longitudinal axis of the furnace with an angle between 0° and 60° to the vertical.

10. The furnace as defined in claim 9, comprising several of said burners (7) disposed substantially along the transversal axis of the furnace with an angle between 0° and 60° to the vertical.

11. The furnace as defined in claim 10, wherein said several burners (7) are disposed with an angle between 0° and 90° to the longitudinal axis of the furnace.

* * * * *